US005529163A

United States Patent [19]

Decker et al.

[11] Patent Number: 5,529,163

[45] Date of Patent: Jun. 25, 1996

[54] COLLECTION, STORAGE AND DISPENSING SYSTEM AND VERTICAL LIFT FOR SHOPPING CARTS

[75] Inventors: Mel Decker, 5441 Vanderpipe Rd., Sarasota, Fla. 34241; Peter W. Mansfield, Holmes Beach, Fla.

[73] Assignee: Mel Decker, Sarasota, Fla.

[21] Appl. No.: 385,163

[22] Filed: Feb. 7, 1995

[51] Int. Cl.[6] ..... G07F 7/00

[52] U.S. Cl. ..... 194/212; 186/60; 194/905; 209/577; 209/939

[58] Field of Search ..... 194/212, 905; 186/58, 60; 209/576, 577, 587, 939

[56] References Cited

U.S. PATENT DOCUMENTS

| | | | |
|---|---|---|---|
| 2,791,291 | 5/1957 | Grondona | 186/60 |
| 3,561,567 | 2/1971 | Bradley . | |
| 3,655,013 | 4/1972 | Weller . | |
| 4,424,893 | 1/1984 | Gillet | 194/905 X |
| 4,518,072 | 5/1985 | Muellner et al. . | |
| 4,518,073 | 5/1985 | Pastien | 186/27 X |
| 5,360,094 | 11/1994 | Adams et al. | 194/212 |

*Primary Examiner*—David H. Bollinger
*Attorney, Agent, or Firm*—Charles J. Prescott

[57] ABSTRACT

A collection, storage and dispensing system (10 or 30) for shopping carts (E) including an elongated tubular conduit sized to allow a shopping cart (E) to rollably pass therethrough. The conduit includes a novel upright or a sloped first end section (38 or 14) defining an entrance opening (16 or 36) through which shopping carts (E) enter the system (10 or 30), a generally horizontal mid section (12, 32 or 52), and a sloping or an upright second end section (18 or 38) which defines an exit opening (20 or 40) through which shopping carts (E) exit the system (10 or 30). The mid section (12 or 32) is preferably buried below grade, but may also be elevated above a parking lot surface of a store for vehicles to drive beneath. A floor (62) is provided within the conduit (52) atop which shopping carts (E) roll. An elongated slender guide engaging probe (112 or 112') is connected to each shopping cart (E) which both laterally guides the carts by slidably engagement into a guide channel (130) longitudinally in the floor (62) and is pullably engaged onto a chain-type conveyor (78) adjacent one end section which is upright. The entrance opening (16 or 36) is positioned at grade level of a store parking area while the exit opening (20, 40 or 56) is positioned within the store at floor level. A denester (104 or 122) interactive with each of the probes (112 or 112') is provided as the carts tend to wedge together. Multiple entrance openings are provided, along with an optical comparator (76) to insure that only proper shopping carts enter the system.

10 Claims, 9 Drawing Sheets

COLLECTION, STORAGE AND DISPENSING SYSTEM AND VERTICAL LIFT FOR SHOPPING CARTS

SCOPE OF INVENTION

This invention relates generally to shopping carts which are used at super-markets, department stores and the like, and more particularly to a system with a unique vertical lift for collecting shopping carts from a parking area, storing those shopping carts and dispensing them back into the store for use.

PRIOR ART

Utilization of a shopping cart at grocery and department store centers has become commonplace. Shoppers may each use such a cart while proceeding through the store to gather items for purchase and checkout. After checkout, the purchased items are typically carried in the shopping cart to the customer's vehicle. After unloading the shopping cart, the customers will typically simply push the shopping cart aside and leave it outside in the parking area of the store. Periodically, employees must then retrieve the shopping carts scattered over a broad area of the parking lot and return them into the store. While unattended, these carts are subject to theft, collision damage with vehicles, vandalism and weather deterioration.

Applicant's are unaware of any system which automatically attends to this gathering or retrieval, storing and dispensing of shopping carts without employee involvement, except for a recently issued U.S. Pat. No. 5,360,094 for which assignee herein is a co-inventor.

A number of prior art devices are directed to some aspect of shopping cart storage and/or handling. In the patent invented by Bradley, U.S. Pat. No. 3,561,567, a storage and dispensing system for shopping carts is disclosed which utilizes compartments within an elongated display case for storing the carts.

In U.S. Pat. No. 3,655,013, Weller teaches floor-to-floor conveying means for movement of shopping carts between floors of a department store. Two tracks of different gauge width are provided to accommodate and guide both front and rear wheels of differing wheel base of the cart.

An apparatus for encouraging the restitution of a shopping cart such as in a reception area otherwise controlled by wickets is disclosed in U.S. Pat. No. 4,424,893 invented by Gillet. This patent discloses an apparatus having vertically hinged doors and dispenses a ticket or token when a proper cart is moved therethrough. This apparatus also identifies unacceptable shopping carts which are dissimilar to those for which the apparatus is designed.

Muellner teaches a cart conveyor and dispensing apparatus in U.S. Pat. No. 4,518,072. This invention is directed to an enclosed conveyor for propelling a shopping cart therethrough. Shopping carts are propelled by engagement of their wheels by a continuous member that carries a cross bump or upwardly extending protrusion.

The present invention provides a shopping cart retrieval system which, without interfering with traffic flow, will facilitate retrieval of shopping carts from the parking area, store those shopping carts in either nested or unnested configuration and then dispense shopping carts into the store as required or desired.

BRIEF SUMMARY OF THE INVENTION

This invention is directed to a collection, storage and dispensing system for shopping carts including an elongated tubular conduit sized to allow a shopping cart to rollably pass therethrough. The conduit includes a novel upright or sloped first end section defining an entrance opening at one end through which shopping carts enter the system, a generally horizontal mid section and a sloping or the novel upright second end section which defines an exit opening through which shopping carts exit the system. The mid section is preferably buried below grade, but may also be elevated above a parking lot surface of a store for vehicles to drive beneath. A floor is provided within the conduit atop which shopping carts roll. An elongated slender guide or probe is connected to each shopping cart which both laterally guides the carts by slidably engagement into a guide channel longitudinally in the floor and is pullably engaged onto a chain-type conveyor in one end section which is upright. The entrance opening is positioned at grade level of a store parking area while the exit opening is positioned within the store at floor level. A denester is provided as the carts tend to wedge together. Multiple entrance openings are provided, along with an optical comparator to insure that only proper shopping carts enter the system.

It is therefore an object of this invention to provide a system for collecting from a parking area, storing and dispensing shopping carts into a store.

It is yet another object of this invention to provide a system for retrieving shopping carts from a parking area of a store, storing those shopping carts and dispensing them into the store without interfering with traffic flow in the parking area.

It is yet another object of this invention to provide a shopping cart retrieval storage and dispensing system which encourages shoppers to return their shopping carts to a remote shopping cart entrance opening located in the parking area without inconveniencing the shopper.

It is yet another object of this invention to provide a retrieval, storage and dispensing system for shopping carts which identifies and rejects shopping carts which are dissimilar to a standard, proper shopping cart for the system.

It is yet another object of this invention to provide a retrieval, storage and dispensing system for shopping carts having a unique vertical lift at one end thereof which will store shopping carts in either a nested or unnested configuration and then automatically denest and dispense those shopping carts into the store as desired.

It is still another object of this invention to provide a unique vertical lift for objects such as shopping carts and other cargo which facilitates horizontal rolling or sliding loading and unloading of the objects.

In accordance with these and other objects which will become apparent hereinafter, the instant invention will now be described with reference to the accompanying drawings.

Figure 9:
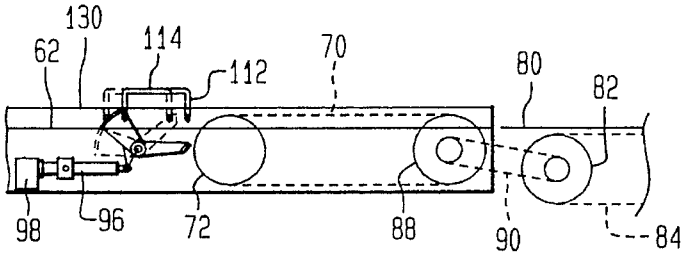
FIG. 9 is a schematic side elevation view of the guide and conveyor mechanism of FIG. 3.
Figure 16A:
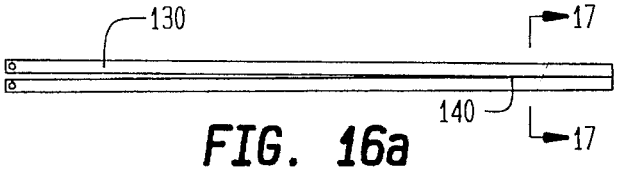

FIG. 16*a* is a top plan view of the shopping cart guide member of FIG. 9 in its open configuration.

Figure 16B:
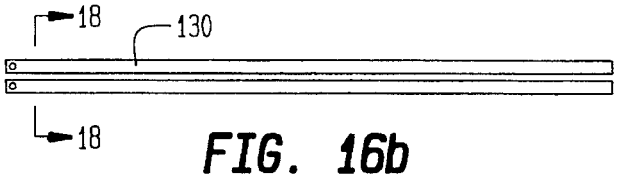

FIG. 16*b* is a view of FIG. 16*a* with one end thereof in a closed or shopping cart braking configuration.

Figure 17:
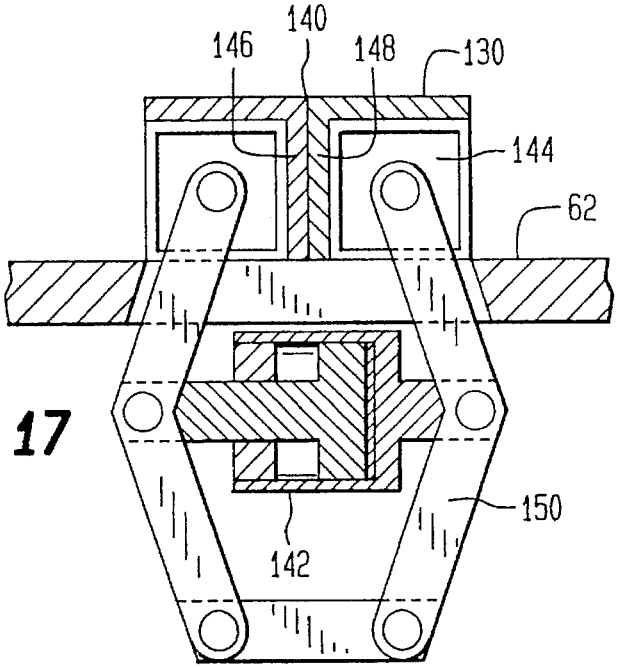

FIG. 17 is a section view in the direction of arrows 17—17 in FIG. 16*a*.

Figure 18:
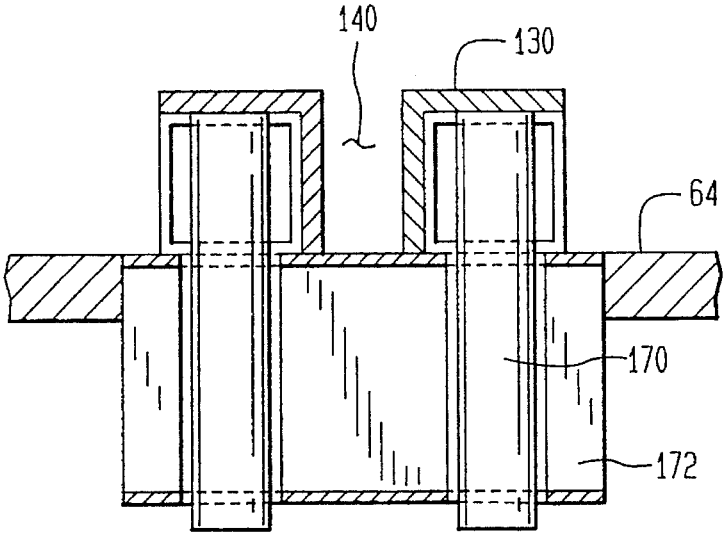

FIG. 18 is a section view in the direction of arrows 18—18 in FIG. 16*b*.

Figure 1:
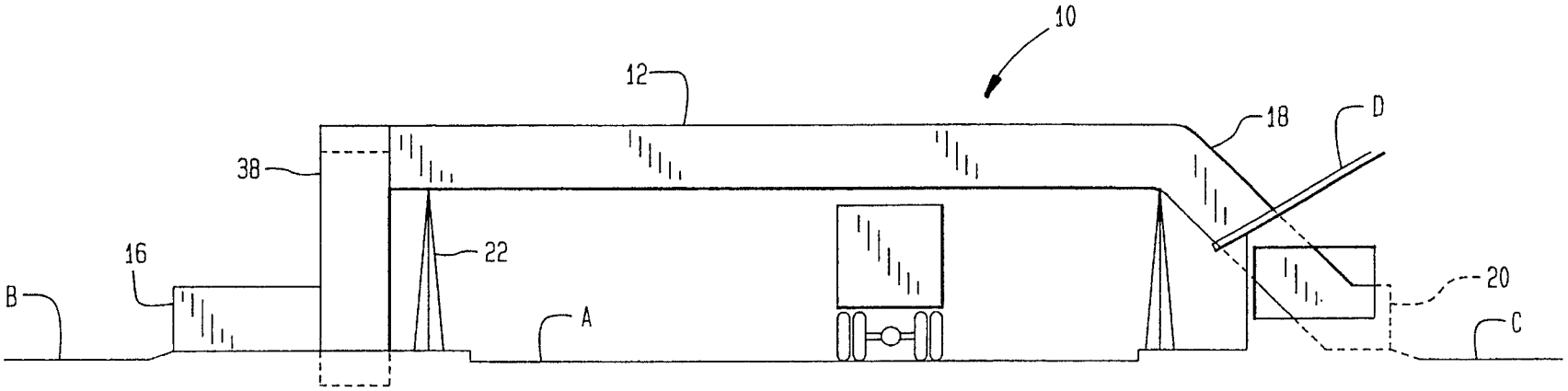
FIG. 1 is a side elevation schematic view of an overhead embodiment of the invention.
Figure 2:
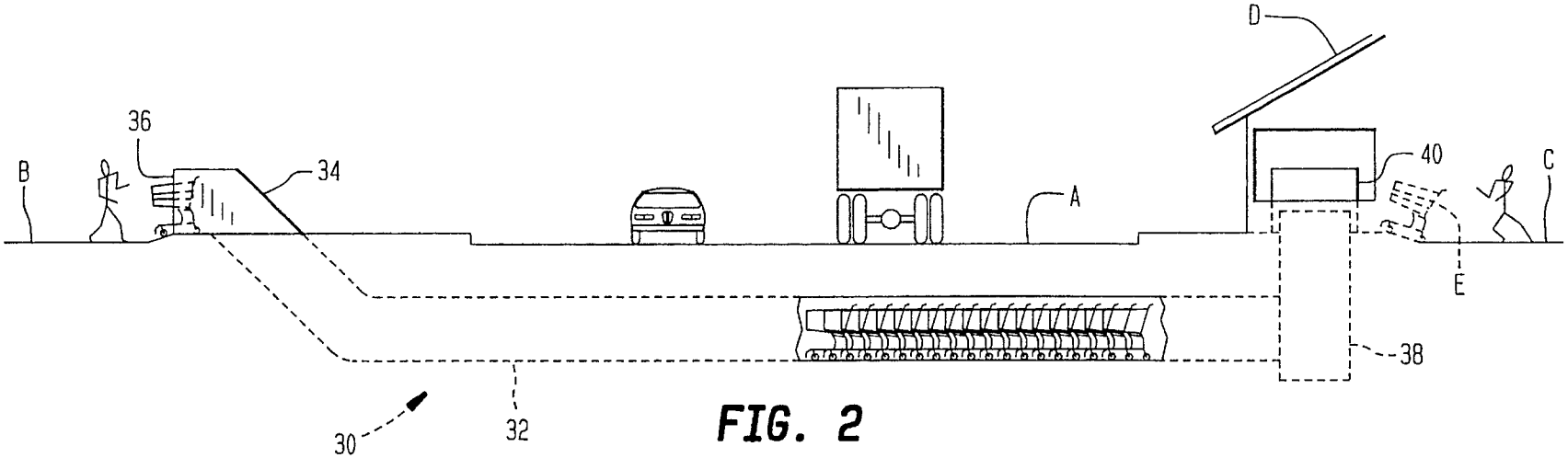
FIG. 2 is a side elevation schematic view of a below grade level embodiment of the invention.
Figure 3:
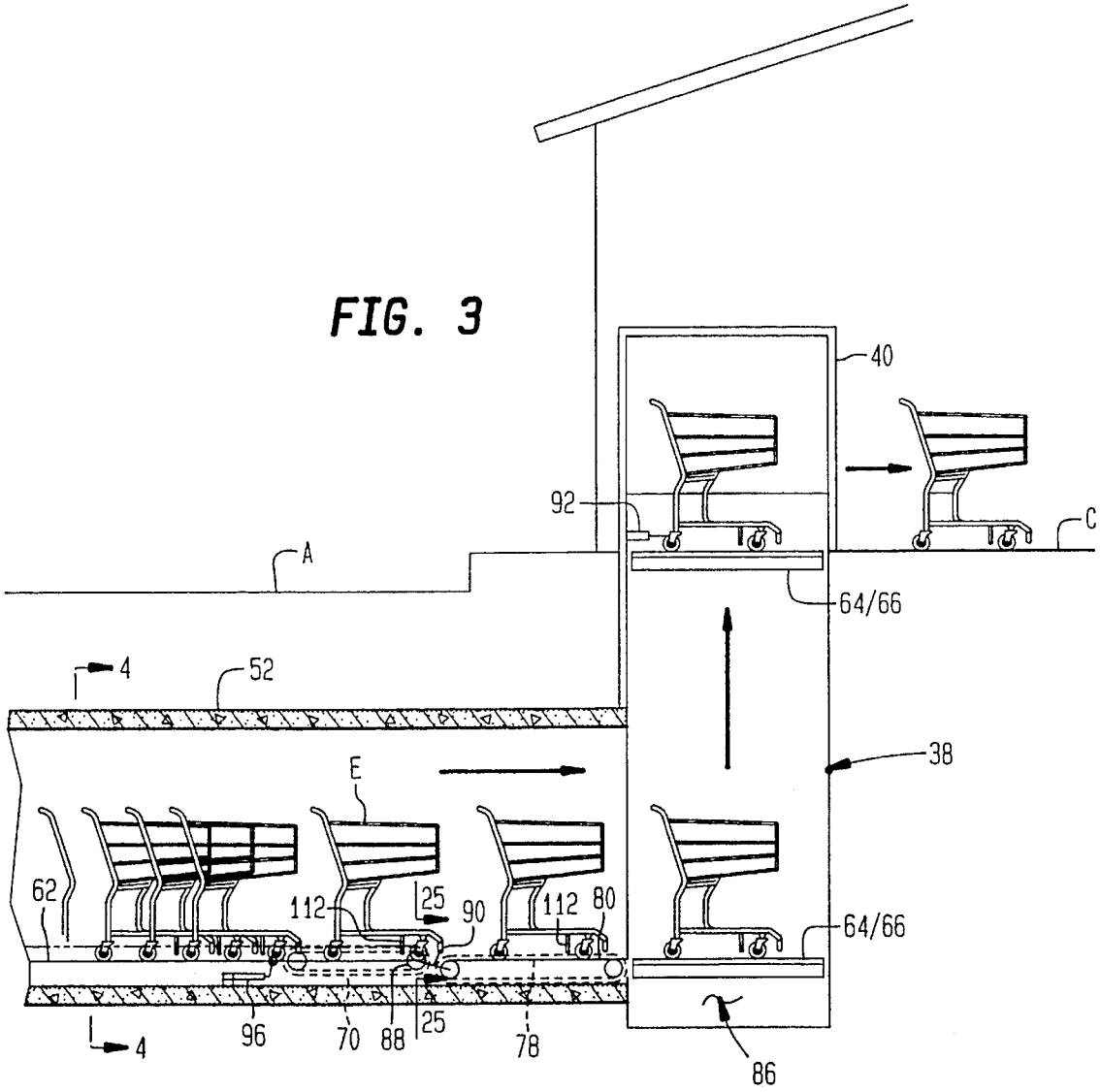
FIG. 3 is a side elevation section view of a portion of the preferred below grade embodiment of the invention.
Figure 19:
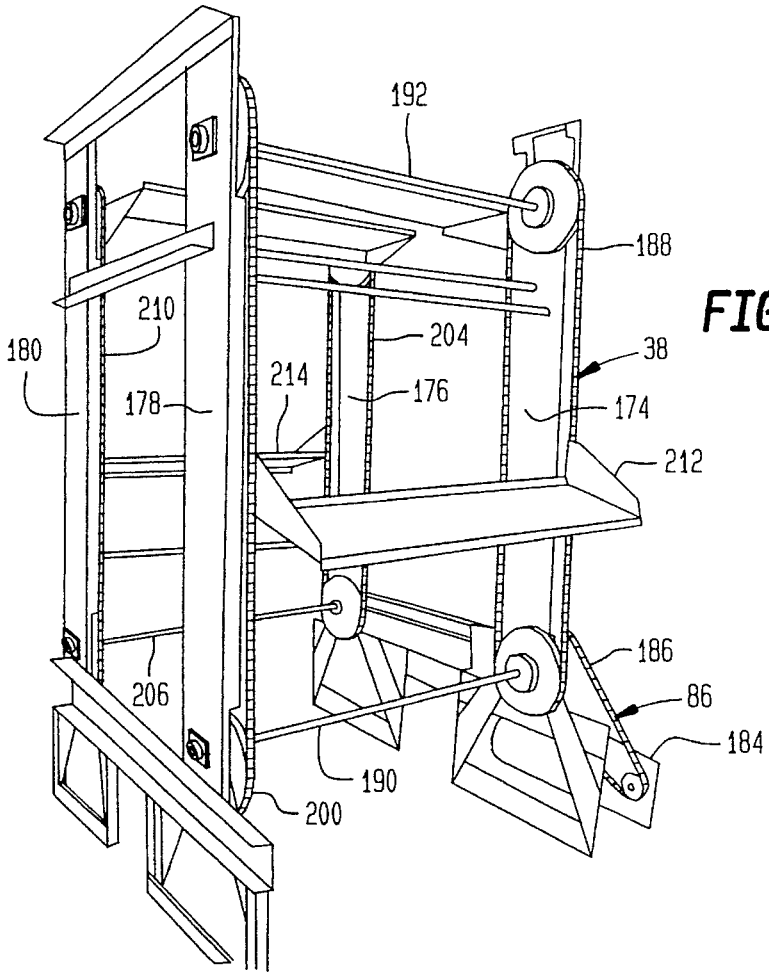

FIG. 19 is a perspective view of the vertical lift forming the first end section of FIG. 1 and the second end section of FIGS. 2 and 3.

Figure 20:
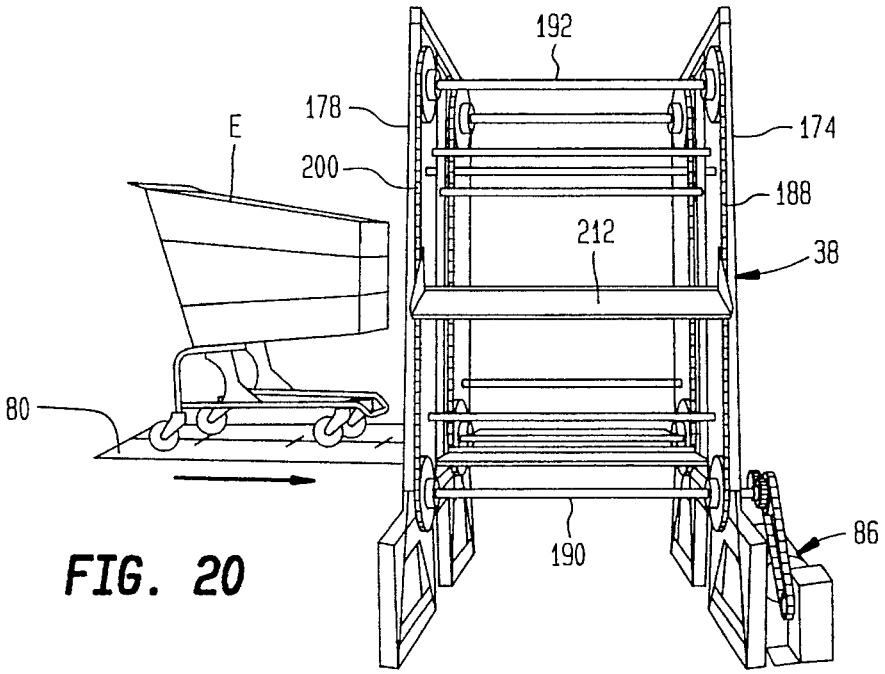

FIG. 20 is a side elevation view of FIG. 1 showing a shopping cart ready for loading.

Figure 21:
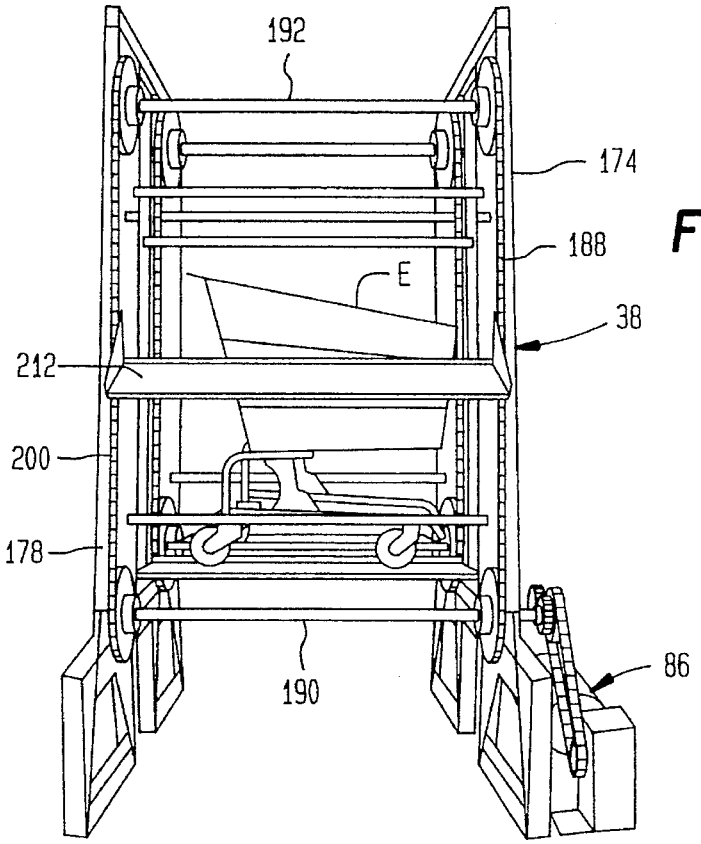

FIG. 21 is an enlarged side elevation view of a portion of FIG. 20 showing the shopping cart loaded and ready for lifting.

Figure 22:
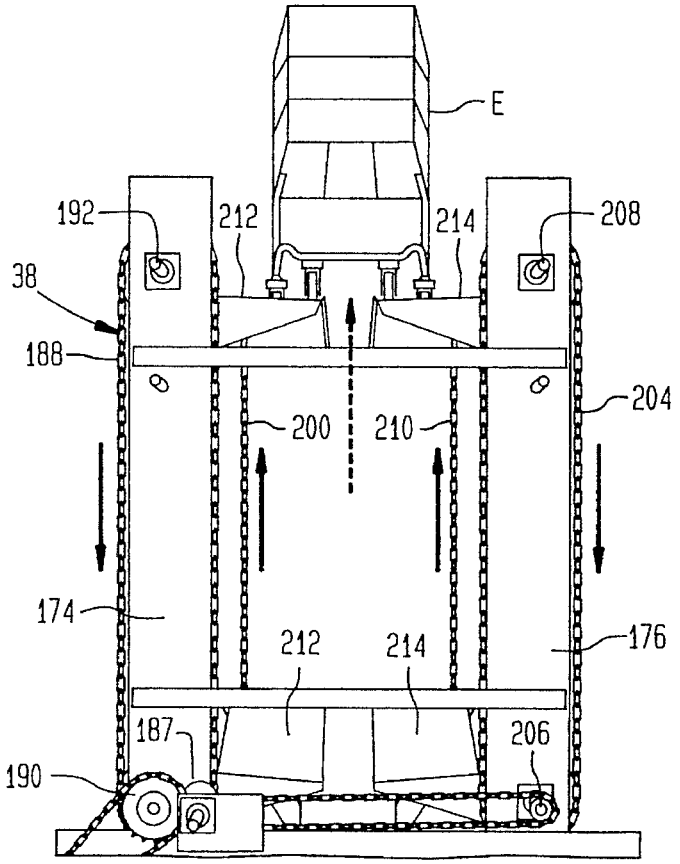

FIG. 22 is an end elevation view of FIG. 2 showing the shopping cart in an elevated position ready for off-loading.

Figure 23:
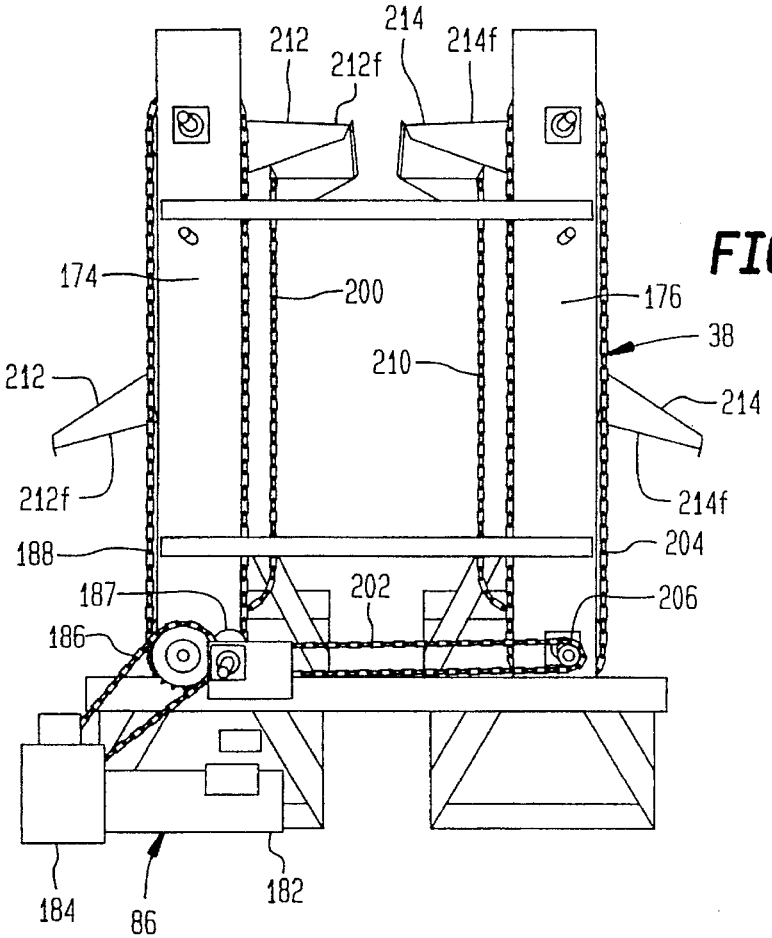

FIG. 23 is an end elevation view of FIG. 22 after removal of the shopping cart.

Figure 24:
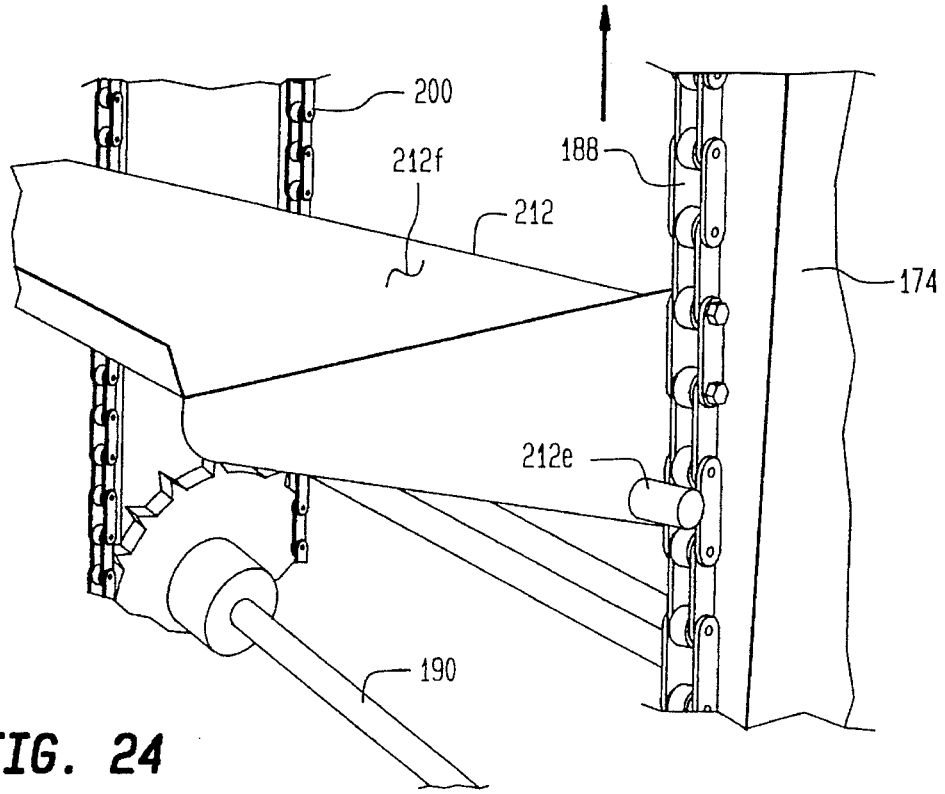

FIG. 24 is an enlarged perspective view of one end of one lifting member.

Figure 25:
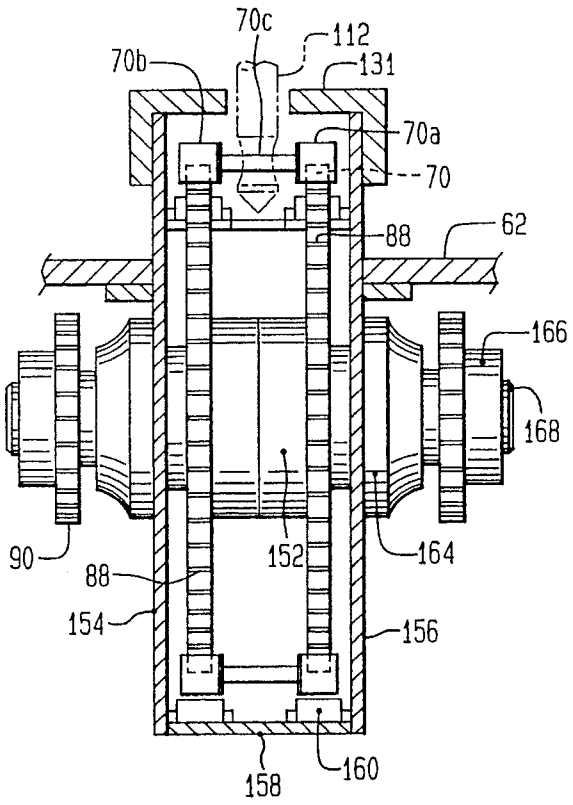

FIG. 25 is a section view in the direction of arrows 25—25 in FIG. 3.

DETAILED DESCRIPTION OF THE INVENTION

Referring now to the drawings, and particularly to FIGS. 1 and 2, one embodiment of the invention is shown generally at numeral 10, that being an overhead embodiment of the invention where the central or mid section 12 of an elongated tubular conduit is positioned and held above a driving surface A of a parking lot by supports 22. This embodiment 10 includes an upright lifting first end section 38 defining an entrance opening 16 positioned at parking grade level B and a downwardly sloped or inclined tubular second end section 18 which defines an exit opening 20 which is positioned within a store D at floor surface level C. Mid section 12 is preferably slightly inclined downward from left to right at an angle of about one to two degrees to allow gravity to assist in moving and gently nesting shopping carts E therein.

In FIG. 2, another embodiment of the invention is shown generally at numeral 30, having a mid section 32 which is positioned below grade level A. This embodiment 30, again includes a tubular mid section 32 which is buried beneath the parking lot drive surface A, extended at a first end by downwardly sloping end section 34 to define an entrance opening 36 positioned at parking grade level B and extended at the opposite or second end by an upright end section 38 to define an exit opening 40 within store D positioned at floor level C.

Figure 4:
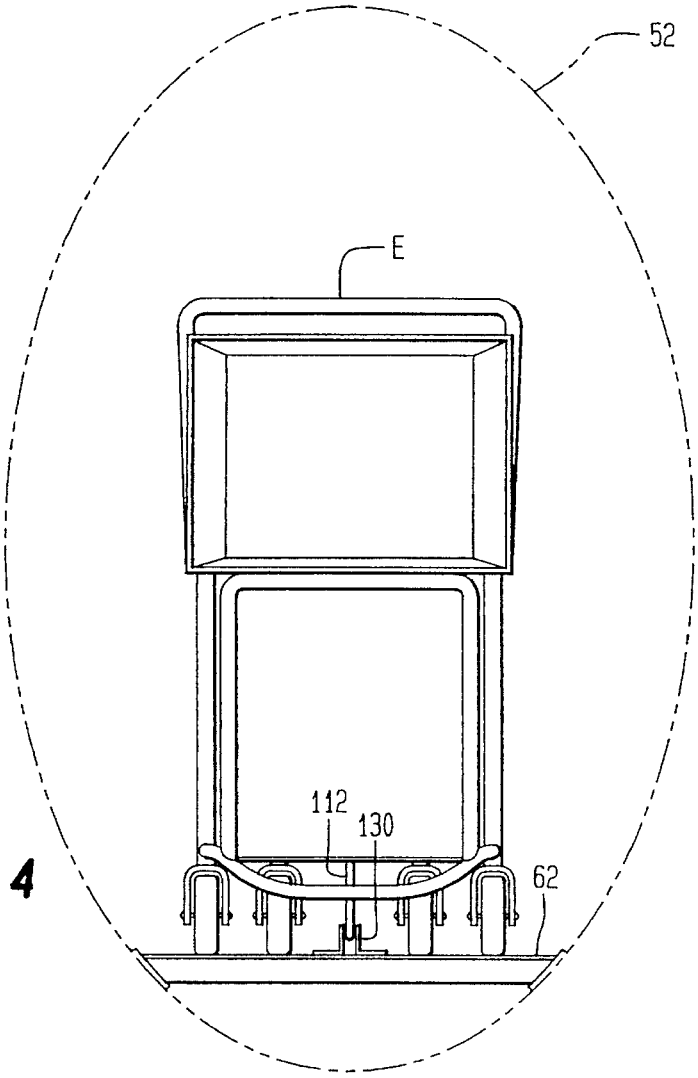
FIG. 4 is a section view in the direction of arrows 4—4 of FIG. 3.
Figure 5:
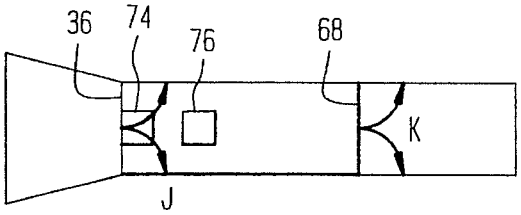
FIG. 5 is a top plan schematic view of one end of the invention shown in FIG. 3 showing the entrance thereof.
Figure 7:
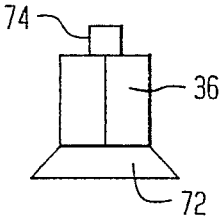
FIG. 7 is a left end elevation view of FIG. 6.
Figure 6:
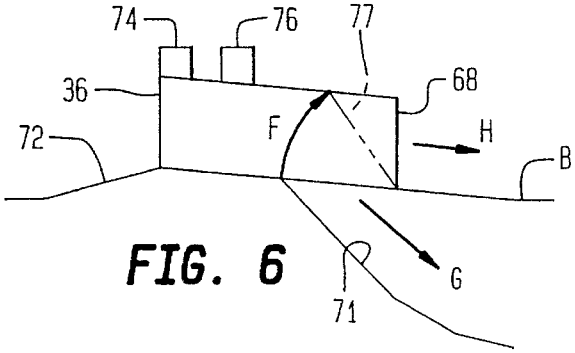
FIG. 6 is a side elevation view of FIG. 5.
Figure 8:
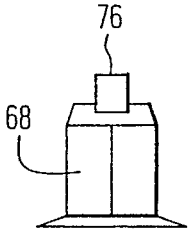
FIG. 8 is a right end elevation view of FIG. 6.

Referring additionally to FIGS. 3 and 4, the preferred tubular conduit structure for a below grade embodiment is in the form of precast reinforced concrete conduit as utilized in highway construction although steel and composite plastic material may also be used. The generally oval or elliptic cross section as shown typically in FIG. 4 in phantom at 52 is further preferred.

Although the embodiment 30 of the invention shown in FIG. 2 envisions rearward orientation of each shopping cart E within the system 30, it is preferred as shown in FIG. 3 that each of the shopping carts E be oriented forwardly. Within each of the end and mid sections of the conduit as typically shown at 52 in FIGS. 3 and 4, a floor structure 62 (typical) is provided to support each shopping cart E. This floor 62 extends horizontally transversely across the lower cross section of the conduit section 52 so that each shopping cart E remains upright with respect to lateral orientation. The floor 62 (typical) also includes two spaced apart channel members 130 which define a longitudinal guide slot therebetween into and along which a downwardly extending probe 112 connected to a lower area of each shopping cart E engages so as to maintain each of the shopping carts E in a laterally central position atop floor 62 (typical).

In the generally preferred embodiment wherein the mid sections 32 and 52 of the conduit are buried beneath the parking lot surface A, once each shopping cart E is pushed through the entrance opening 36 in FIG. 2 (not shown in FIG. 3), gravity acts to move each shopping cart E downwardly through sloped end conduit section 34 in FIG. 2 (not shown in FIG. 3) and then along the mid section 32 or 52 until becoming nested with the next forwardly positioned shopping cart as shown in FIGS. 2 and 3. To further enhance the action of gravity to accomplish this nesting of shopping carts for storage, each of the mid sections 32 and 52 are sloped downwardly at a preferred slope of up to about ten degrees (10°) toward the end section 38. Alternately, live conveyor means (not shown) could be added to assist in rolling damaged shopping carts into a nested arrangement.

Referring now to FIGS. 5 to 8, the details of the preferred embodiment of the entrance opening 36 and associated downwardly sloping conduit structure is there shown. A pair of swinging doors are pivotally connected at their outer opposing margins so that a shopping cart E may be pushed up lead-in ramp 72 into these doors for opening in the direction of arrows J in FIG. 5. An optical comparator 76 is provided for scanning the shopping cart which has been so introduced through entrance 36. If the shopping cart differs from a standard image or includes articles remaining therein such as a purse or groceries, the optical comparator 76 provides a reject signal which prevents trap door 77 from opening in the direction of arrow F. In such event, the cart will then discharge by gravity in the direction of arrow H because of the sloped surface out from hinged doors 68 which open in the direction of arrow K.

If the optical comparator 76 properly identifies an acceptable shopping cart E, trap door 77 then opens in the direction of arrow F so that the shopping cart E will be carried downwardly by gravity on surface 71 in the direction of arrow G into the system. Simultaneously with opening of the trap door 77, a token dispenser 74 dispenses a single token which the shopper may then redeem in the store D on a subsequent shopping visit.

Figure 15:
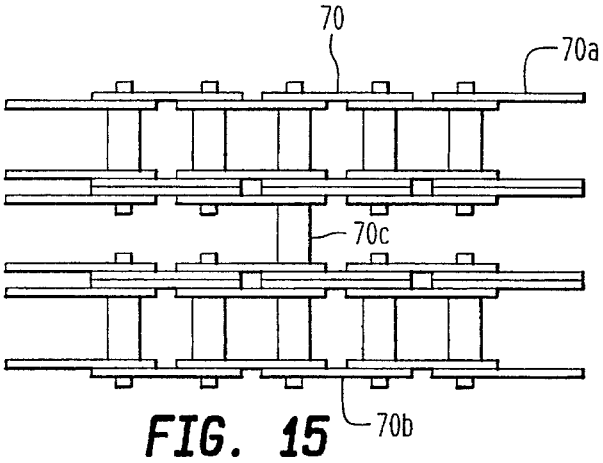
FIG. 15 is a top plan view of a portion of a conveyor chain of FIG. 9.

As best seen in FIGS. 3 and 9, a short drive chain 70, similar in construction to that shown in FIG. 15, being driven by sprocket 88, which also drives chain 90, acts cooperatively to denest or separate each of the shopping carts E before entering into engagement with the vertical lift 58 as will be described herebelow. Referring additionally to FIGS. 15 and 25, the endless or continuous double row chain 70 is drivably engaged over toothed gears 88 of double row sprockets 152 so that each of its rows or links 70*a* and 70*b* are drivably engaged. Periodically spaced cross drive pins 70*c* in FIG. 15 are provided to drivably engage against probe 112 as previously described.

Figure 10:
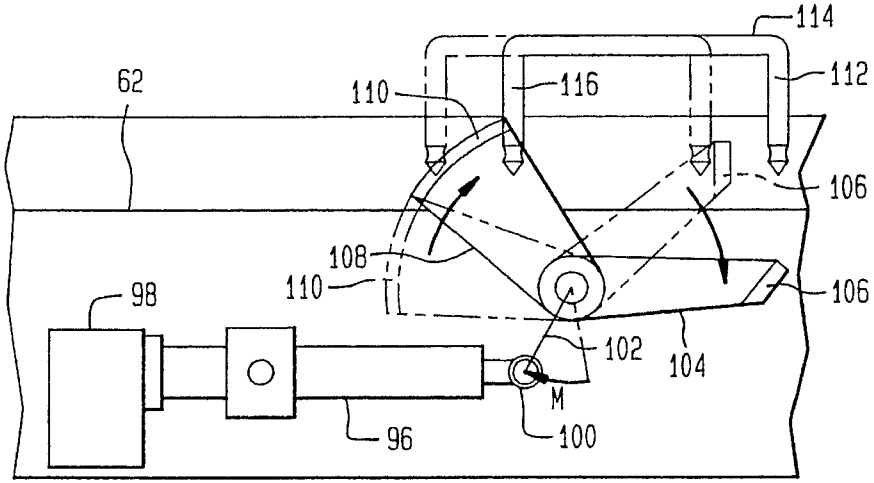
FIG. 10 is an enlarged view of one embodiment of a shopping cart denester shown in FIG. 9.

In FIG. 10, the details of one embodiment of the denester as shown in FIG. 9 are now described. Actuator 96 mounted on block 98, moves its end pivot connection 100 in the direction of arrow M for each denesting cycle. This movement, in turn, pivots link 102 which is connected with arm plates 104 and 108 pivoting them in the direction of the arrows. Flange 106, previously engaged against probe 112 (in phantom) thus moves out of the way. Flange 110 then rotates upwardly so as to block movement of the next rearward probe 112 (not shown). Simultaneously, the leading edge of flange 110 contacts against probe 116 so as to urge the cross member 114, from which these two downwardly extending probes 112 and 116 depend and shopping cart E to which it is connected, forwardly for engagement with chain 78.

Figure 11:
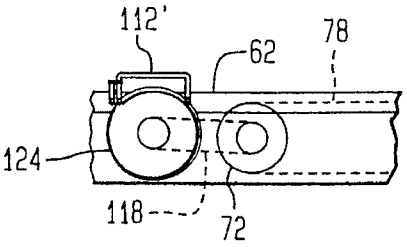
FIG. 11 is a partial view of another embodiment of a shopping cart denester.
Figure 12:
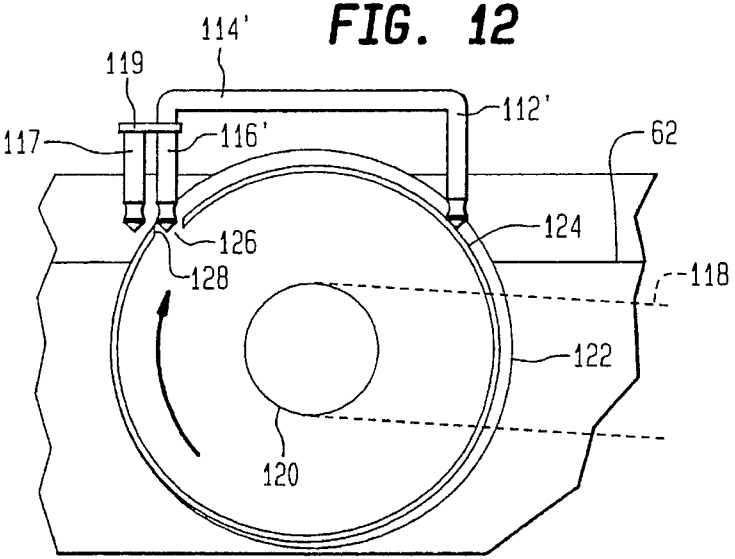
FIG. 12 is an enlarged view of FIG. 11.

An alternate embodiment of a denesting arrangement is shown in FIGS. 11 and 12 which incorporates a dual probe arrangement 112'/116'/117' and a rotating denesting drum 124 mounted on plate 122 driven on sprocket 120 by chain drive 122. A single slot 126 is formed into cylindrical drum 124 so that, as it rotates in the direction of the arrow, driven by chain 118, slot 126, being outwardly formed at 128 engages in between dual probes 116' and 117', connected by bracket 119. As the cylindrical drum 124 rotates in this fashion, the next rearward probe 112' (not shown) is prevented from movement by contact against the smooth surface of drum 124 so that the associated forward cart to which member 114' is connected is driven forwardly and denested from the next rearward shopping cart E. Note importantly that both of these denester arrangements are reversible.

As best seen in FIGS. 16*a*, 16*b*, 17 and 18, a braking arrangement is provided within mid section 52 of FIG. 3. This breaking arrangement is in the form of closable guide rails 130 so that the slot 140 is variable in width by hydraulic actuator 142 which acts upon pivoted links 150 to urge blocks 144 together along with upright faces 148 and 148. This closing action provides frictional engagement against probe 112. In FIG. 18, guide channels 130 are fixed in position by members 170 within 172 rigidly connected to floor section 64 so that gap 140 is maintained at a width slightly greater than the diameter of probe 112.

Figure 13:
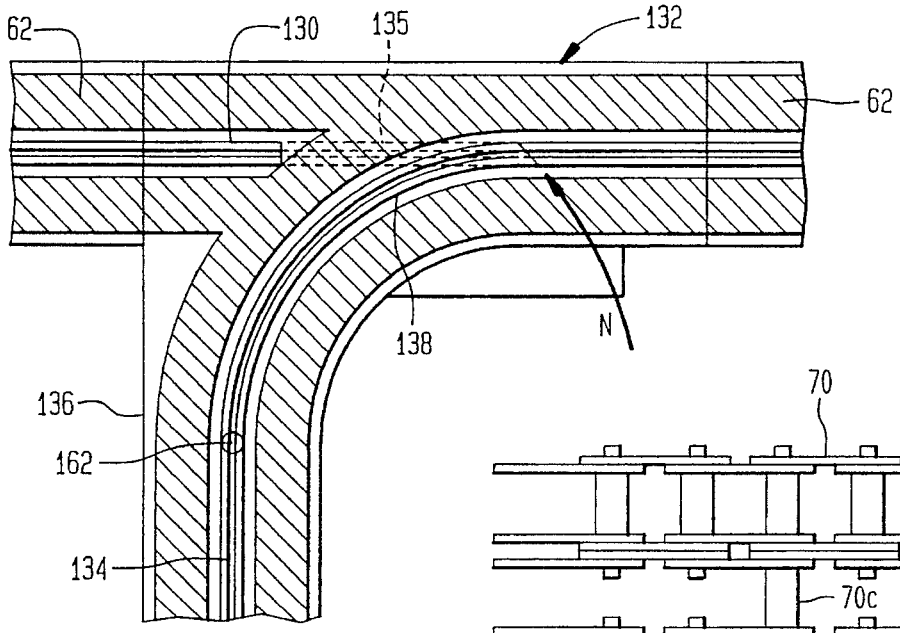
FIG. 13 is a top plan view of a shopping cart guide switch which accommodates both main and branch shopping cart conduits, the switch being in a position to accept shopping carts from the branch conduit.
Figure 14:
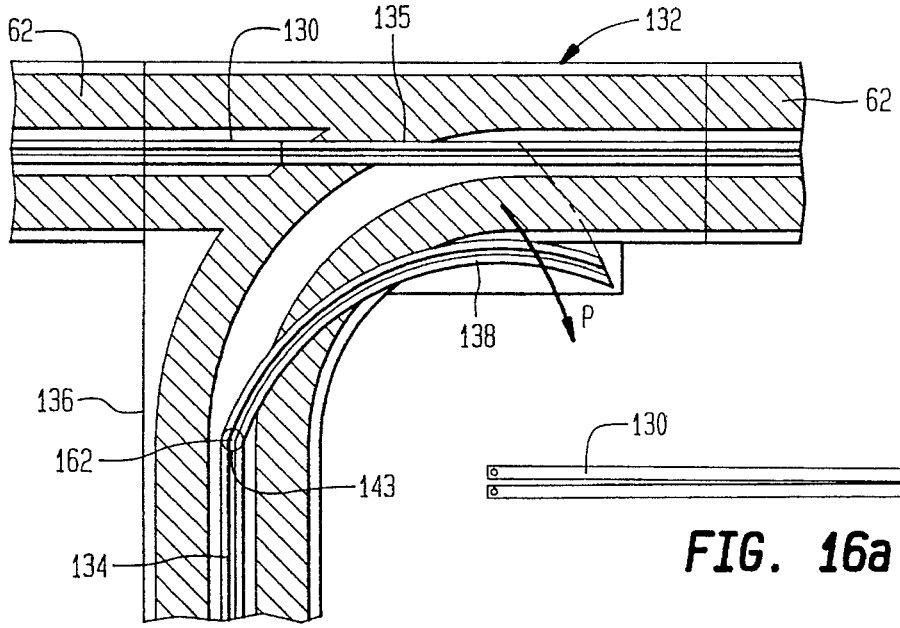
FIG. 14 is a view similar to FIG. 13 wherein the switch is in a position to accept shopping carts from the main conduit.

Although a single entrance opening may be provided at a single fixed location within a parking lot area, called a main entrance opening as previously described, branch entrance openings may be provided as well, strategically placed around the parking area. These branch entrances would be similar to that previously described. Within the mid section 52 of the system 50, as best seen in FIGS. 13 and 14, a branch switch is generally shown at 132 and includes a pivotally mounted arcuate channel or guide section 138 on floor 136 for engagement with probe 112 as previously described. This arcuate channel section 138, when pivoted about 162 in the direction of arrow N allows shopping carts to be merged onto the floor 62 of the main mid section 52. As arcuate member 138 is rotated in the direction of arrow N, a section 135 of the guide member 130 is also lowered.

To disengage arcuate member 138, pivoting in the direction of arrow P in FIG. 14 is provided while raising section 135 back to the same height as channel guide member 130. At that time, shopping carts moving within guide member 134 will contact against surface 143 and stopped.

Referring additionally to FIGS. 19 to 24, the vertical lift end section or tower 38 will now be described. In FIG. 1, this vertical lifting section 38 is utilized to receive shopping carts through opening 16 while, in FIG. 2, this lifting section 38 is utilized to raise shopping carts from the below-grade mid section 32 for discharge through opening 40 into the store D.

The lifting section 38 comprises a drive assembly shown generally at 86 which includes an electric motor 182 driving a reduction gear assembly 184 having a rotary output shaft engaged with endless drive chain 186 This chain 186 drives sprocket shaft 190 and by drive chains 188 and 200, sprockets shaft 192 and the corresponding sprocket plates are driven in unison. Through a reversing spur gear 187, sprocket shafts 206 and 208 are driven in reverse rotation so that the inner facing portions of drive chains 188, 200, 204 and 210 all move upwardly at the identical feed rate. These sprocket shafts 190, 192, 206, and 208 are securely mounted for rotation only on the corresponding upright frame members 174, 176, 178 and 180.

At least one pair, and preferably two pairs, of opposing, spaced apart lifting plates 212 and 214 are connected at each end thereof to the corresponding drive chains 188, 200, 204 and 210 as best seen in FIG. 24. These lifting plates 212 and 214 are formed of sheet steel material or the like having an elongated generally rectangular configuration strengthened by flange 121*a* (typical) to define generally flat, horizontally oriented coplanar working surfaces 212*f* and 214*f*. Each of the lifting plate 212 and 214 are connected to the corresponding drive chains 188, 200, 204 and 210 by bolts 212*c* and 212*d* (typical.) in FIG. 24.

By this arrangement, as the drive chains move in unison at identical rates of speed, each of the lifting plates 212 and 214 first moving upwardly and in close proximity in edge-to-edge or spaced orientation to define a combined horizontal lifting surface defined by lifting surfaces 212*f* and 214*f*. These lifting plates 212 and 214 then move downwardly spaced further apart with the lifting surfaces 212*f* and 214*f* facing downwardly.

To stabilize and strengthen the lifting plates 212 and 214 when moving upwardly in a lifting mode, pins 212*e* (typical) are also provided which bear against the corresponding drive chain as seen in FIGS. 24, while allowing the lifting plates 212 and 214 to follow each of the drive chains arcuately around the sprocket plates at the top and bottom of travel.

As seen in FIGS. 3 and 20, a shopping cart E is positioned atop support panel 80 ready for loading onto one set of lifting plates 212 and 214 which are aligned vertically to be coplanar with one another and support panel 80. Drive chain 78 having a structure similar to the drive chain 70 of FIGS. 15 and 25 is then activated so as to engage probe 112 to load the shopping cart E into the position shown in FIG. 21. Thereafter, as best seen in FIG. 22, the drive mechanism 86 of lifting section 38 is activated to move the lifting plates 212 and 214, with the shopping cart E thereatop upwardly to an upper off-load position, whereupon, as seen in FIG. 3, a hydraulic linear actuator 92 or the like moves or pushes the shopping cart E onto the floor surface 0 exiting opening 40.

Viewed more broadly, this lifting section or tower 38 may be utilized to lift and/or lower a broad range of objects in addition to shopping carts. By providing a vertically movable working surface defined by the spaced apart coplanar working surfaces 212*f* and 214*f*, loading and off loading of objects by a conveyor or drive means positioned between these lifting plates 212 and 214 is facilitated. Thus, objects may be loaded by sliding or rolling directly onto the lifting plates 212 and 214 by means of a chain drive or a linear actuator positioned between these lifting plates 212 and 214 and a similar off loading device may be utilized in the off loading position.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

We claim:

1. A collection, storage and dispensing system for shopping carts comprising:

an elongated tubular conduit means sized to allow a shopping cart to be rolled in generally upright longitudinal orientation therethrough;

said conduit means having a generally horizontal mid section positioned below a driving surface of a parking area adjacent a store and first and second end sections, said first end section sloping and defining a shopping cart main entrance opening positioned at grade level of the parking area at a remote location from the store, said second end section being upright and defining a shopping cart exit opening positioned at floor level within the store;

a floor means sized and positioned within said first end section and said mid section for rollably supporting a plurality of shopping carts thereon;

downwardly extending engaging means connected to a lower area of each shopping cart;

guide means centrally positioned along said floor means for receiving and laterally directing each one of said engaging means whereby each shopping cart entering said conduit means is generally centered and guided along said floor means;

conveyor means mounted in said mid section floor engagable with each said engaging means for transporting each shopping cart along said mid section floor, each cart being assisted by gravity to roll along said first end section floor after passing through said main entrance opening;

means within said second end section for vertically lifting each shopping cart from said mid section up to the floor level within the store for discharge from said exit opening.

2. A collection, storage and dispensing system as set forth in claim 1, further comprising:

denesting means positioned in said mid section adjacent to said second end section for separating adjacent shopping carts from one another just prior to each shopping cart entering onto said second end section.

3. A collection, storage and dispensing system as set forth in claim 2, further comprising:

braking means in a portion of said guide means along said mid section for frictional contact with said engaging means to slow the speed of forward roll of each shopping cart.

4. A collection, storage and dispensing system as set forth in claim 3, further comprising:

an elongated tubular branch conduit means sized to allow a shopping cart to be rolled in generally upright longitudinal orientation therethrough;

said branch conduit means having a generally horizontal branch mid section positioned below grade level and a sloping first end section defining a shopping cart branch entrance opening positioned at grade level of the parking area, one end of said branch mid section connected by a branch switch to said mid section;

branch floor means sized and positioned within said branch conduit means for rollably supporting a plurality of shopping carts thereon;

branch guide means centrally positioned along said additional floor means for receiving and laterally directing each one of said engaging means whereby each shopping cart entering said branch conduit means is generally centered and guided along said branch floor means;

said branch switch being switchable to allow shopping carts to pass therealong from either said main entrance opening or said branch entrance opening.

5. A collection, storage and dispensing system as set forth in claim 4, further comprising:

means for issuing a token for each shopping cart passing into said entrance opening;

said token being redeemable in the store.

6. A collection, storage and dispensing system as set forth in claim 1, further comprising:

an optical comparator means positioned in said first end section adjacent said entrance opening;

said optical comparator means viewing each shopping cart passing through said entrance opening for comparison to a standard shopping cart image;

a trip door means positioned generally horizontally in said first end section which opens automatically to allow each shopping cart passing through said entrance opening which is optically similar to said standard shopping cart to continue into said mid section;

a reject door means positioned at grade level through which all shopping carts optically dissimilar to said standard shopping cart image will automatically pass back onto grade level when said trip door remains in a closed position.

7. A collection, storage and dispensing system for shopping carts comprising:

an elongated tubular conduit means sized to allow a shopping cart to be rolled in generally upright longitudinal orientation therethrough;

said conduit means having a generally horizontal mid section positioned above grade level a distance sufficient for vehicles to drive thereunder spanning a driving surface adjacent a store, said conduit means also having first and second end sections, said first end section being upright and defining a shopping cart entrance opening positioned at the grade level of a parking area remotely located from the store, said second end section sloping and defining a shopping cart exit opening positioned at floor level within the store;

a floor means sized and positioned within said mid and second end sections for rollably supporting a plurality of shopping carts thereon;

downwardly extending engaging means connected to a lower area of each shopping cart;

guide means centrally positioned along said floor means for receiving and laterally directing each one of said engaging means whereby each shopping cart entering said conduit means is generally centered and guided along said floor means;

conveyor means mounted in said mid section floor engagable with each said engaging means for transporting each shopping cart along said mid section floor;

means within said first end section for vertically lifting each shopping cart from said entrance opening up into said mid section.

8. A collection, storage and dispensing system as set forth in claim 7, further comprising:

denesting means positioned in said mid section adjacent to said second end section for separating adjacent shopping carts from one another just prior to each shopping cart entering onto said floor means in said second end section.

9. A collection, storage and dispensing system as set forth in claim 8, further comprising:

an elongated tubular branch conduit means sized to allow a shopping cart to be rolled in generally upright longitudinal orientation therethrough;

said branch conduit means having a generally horizontal branch mid section positioned below grade level and a sloping first end section defining a shopping cart branch entrance opening positioned at grade level of the parking area, one end of said branch mid section connected by a branch switch to said mid section;

branch floor means sized and positioned within said branch conduit means for rollably supporting a plurality of shopping carts thereon;

branch guide means centrally positioned along said additional floor means for receiving and laterally directing each one of said engaging means whereby each shopping cart entering said branch conduit means is generally centered and guided along said branch floor means;

said branch switch being switchable to allow shopping carts to pass therethrough from either said main entrance opening or said branch entrance opening.

10. A collection, storage and dispensing system as set forth in claim 7, further comprising:

an optical comparator means positioned in said first end section adjacent said entrance opening;

said optical comparator means viewing each shopping cart passing through said entrance opening for comparison to a standard shopping cart image;

a trip door means positioned generally horizontally in said first end section which opens automatically to allow each shopping cart passing through said entrance opening which is optically similar to said standard shopping cart to continue into said mid section;

a reject door means positioned at grade level through which all shopping carts optically dissimilar to said standard shopping cart image will automatically pass back onto grade level when said trip door remains in a closed position.

* * * * *